US007122967B2

(12) United States Patent
Jo et al.

(10) Patent No.: US 7,122,967 B2
(45) Date of Patent: Oct. 17, 2006

(54) FIELD EMISSION DISPLAY AND DRIVING DEVICE THEREOF

(75) Inventors: Seong-Keun Jo, Yongin (KR); Mun-Seok Kang, Anyang (KR); Hyang-Suk No, Cheollabuk-do (KR)

(73) Assignee: Samsung SDI Co., Ltd., Suwon (KR)

( * ) Notice: Subject to any disclaimer, the term of this patent is extended or adjusted under 35 U.S.C. 154(b) by 92 days.

(21) Appl. No.: 10/747,064

(22) Filed: Dec. 30, 2003

(65) Prior Publication Data

US 2004/0150353 A1 Aug. 5, 2004

(30) Foreign Application Priority Data

Jan. 17, 2003 (KR) ..... 10-2003-0003281

(51) Int. Cl.
*G09G 3/10* (2006.01)

(52) U.S. Cl. ..... 315/169.1; 313/495

(58) Field of Classification Search .. 315/169.1–169.4; 313/74–76, 84, 211–214, 292, 309, 495–497, 313/504–506, 399; 345/74, 75, 77
See application file for complete search history.

(56) References Cited

U.S. PATENT DOCUMENTS

| | | | | |
|---|---|---|---|---|
| 5,910,792 | A * | 6/1999 | Hansen et al. | 345/77 |
| 6,040,973 | A * | 3/2000 | Okamoto et al. | 315/169.1 |
| 6,169,371 | B1 * | 1/2001 | Zimlich et al. | 315/169.1 |
| 6,346,931 | B1 * | 2/2002 | Cathey et al. | 315/169.3 |
| 6,404,136 | B1 * | 6/2002 | Murray et al. | 315/169.1 |
| 6,448,717 | B1 * | 9/2002 | Rasmussen | 313/495 |
| 6,873,100 | B1 * | 3/2005 | Park et al. | 313/506 |

* cited by examiner

*Primary Examiner*—Wilson Lee
(74) *Attorney, Agent, or Firm*—H.C. Park & Associates, PLC

(57) ABSTRACT

A field emission display with a first substrate and a second substrate which are arranged opposite to each other and have a specific distance between them. At least one first electrode is formed on the first substrate and at least one second electrode is formed on the second substrate. At least one third electrode is insulated from the first electrode and an electron emission source is connected to the third electrode. A fourth electrode controls the electrons emitted from the electron emission source so that they reach the second electrode. A driver detects a current flowing through the fourth electrode and controls a driving voltage applied to the fourth electrode based on the detected current.

30 Claims, 4 Drawing Sheets

FIELD EMISSION DISPLAY AND DRIVING DEVICE THEREOF

CROSS REFERENCE TO RELATED APPLICATION

This application is based on Korea Patent Application No. 2003-3281 filed on Jan. 17, 2003 in the Korean Intellectual Property Office, the content of which is incorporated herein by reference in its entirety.

BACKGROUND OF THE INVENTION

1. Field of the Invention

The invention relates to a field emission display and a device for driving the field emission display.

2. Description of the Related Art

A field emission display is a display device that forms images using cold cathode electrons as an electron emission source. The quality of the field emission display depends on characteristics of the electron emission source, such as the material and the structure of the electron emission source.

In general, a field emission display has a triode structure with a cathode electrode, an anode, and gate electrode. The field emission display is constructed such that the cathode electrode is formed on a substrate on which the electron emission source is placed and an insulating layer and the gate electrode are formed on the cathode electrode. The insulating layer has a contact hold and the electron emission source is formed in the contact hole whereby the electron emission source is coupled with the cathode electrode.

In a field emission display with such a structure, when electrons emitted from the electron emission source from an electron beam and go toward a corresponding phosphor, accurate focusing of the electron beam may not be achieved.

For accurate focusing, a structure has been proposed in which a mesh-type or grid-type electrode (referred to as grid electrode hereinafter) is located between the cathode electrode and the anode electrode. Voltage is applied to the grid electrode to allow the electrons emitted from the electron emission source to go toward a corresponding phosphor.

However, if the grid electrode is not provided with a proper voltage, the gate voltage influences the grid electrode to generate divergence. As such, the electrons emitted from the electron emission source reach not only the phosphor, but also other parts of the display.

Accordingly, all the electrons emitted from the electron emission source do not flow into the anode electrode, but some go into the grid electrode while the field emission display is operating. Electron emission to the grid electrode induces undesired electron flow, which may generate a surge current in the event of arcing, turning on the field emission display or timing off the field emission display, and thereby damage the device for driving the field emission display.

SUMMARY OF THE INVENTION

This invention provides a driving device for uniformly controlling the quantity of current flowing through a grid electrode that is located between an electron emission source and phosphors of a field emission display, to control the direction of electrons in a field emission display.

This invention separately provides a field emission display comprising first and second substrates arranged opposite to each other and having a specific distance between them. At least one first electrode is formed on the first substrate and at least one second electrode is formed on the second substrate. At least one third electrode is insulated from the first electrode and an electron emission source is connected to the third electrode. A fourth electrode is formed between the first and second substrates where the fourth electrode controls the electrons emitted from the electron emission source direct them to the second electrodes. A driver for detecting a current flowing through the fourth electrode and controlling a driving voltage applied to the fourth electrode according to the detected current is also provided to allow the current flowing through the fourth electrode to be substantially maintained at a predetermined value.

A driver which includes a first current pass part which is coupled to the fourth electrode, to bias the current flowing through the fourth electrode and a second current pass part which is coupled to the fourth electrode, to bias the current flowing through the fourth electrode. The device further includes a reference voltage generator for generating a reference voltage and a controller for selectively operating the first and second current pass parts based on the reference voltage in order to control the driving voltage applied to the fourth electrode according to a voltage caused by current flowing through the first or second current pass part.

This invention separately provides a device for driving a field emission display including first and second substrates arranged opposite to each other having a specific distance there between. At least one first electrode is formed on the first substrate and at least one second electrode formed on the second substrate. At least one third electrode is insulated from the first electrode and an electron emission source is connected to the third electrode. A fourth electrode is formed between the first and second substrates and controls electrons emitted from the electron emission source to direct them to the second electrodes. The device includes a first current pass part coupled to the fourth electrode, for biasing the current flowing through the fourth electrode and a second current pass part coupled to the fourth electrode for biasing the current flowing through the fourth electrode. The device also includes a reference voltage generator for generating a reference voltage and a controller for selectively operating the first and second current pass parts based on the reference voltage in order to control the driving voltage applied to the fourth electrode according to voltage caused by current flowing through the first or second current pass part.

BRIEF DESCRIPTION OF THE DRAWINGS

The accompanying drawings, which are included to provide a further understanding of the invention and are incorporated in and constitute a part of this application, illustrate exemplary embodiment(s) of the invention, and together with the description serve to explain the principle of the invention.

DETAILED DESCRIPTION OF THE INVENTION

Figure 1:
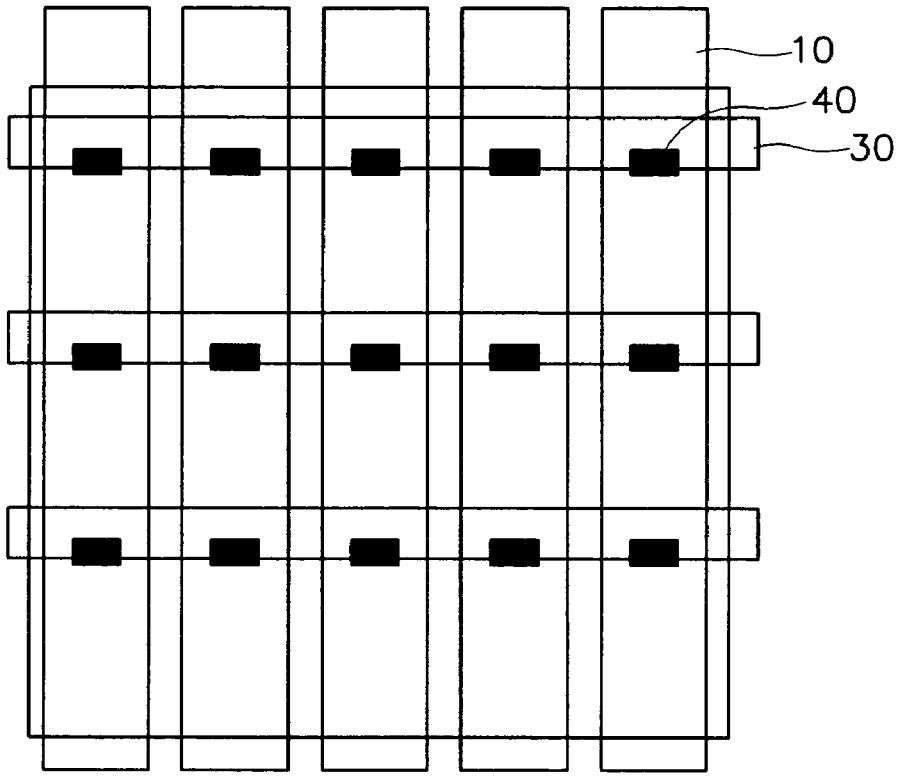
FIG. 1 is a plan view of a lower substrate of a field emission display according to an exemplary embodiment of the present invention.

Reference will now be made in detail to the exemplary embodiments of the present invention, examples of which are illustrated in the accompanying drawings. Parts without relation to explanation of the invention are omitted in the drawings in order to describe the invention definitely. For reference, like reference characters designate corresponding parts throughout the Figures. When it is described that a part such as a layer, film, or plate is located "on" another part, that part may be placed immediately on the other part another part may be located between the two parts. On the contrary, when a certain part is placed "right on" another part, it means that there is no other part between the two parts.

Figure 2:
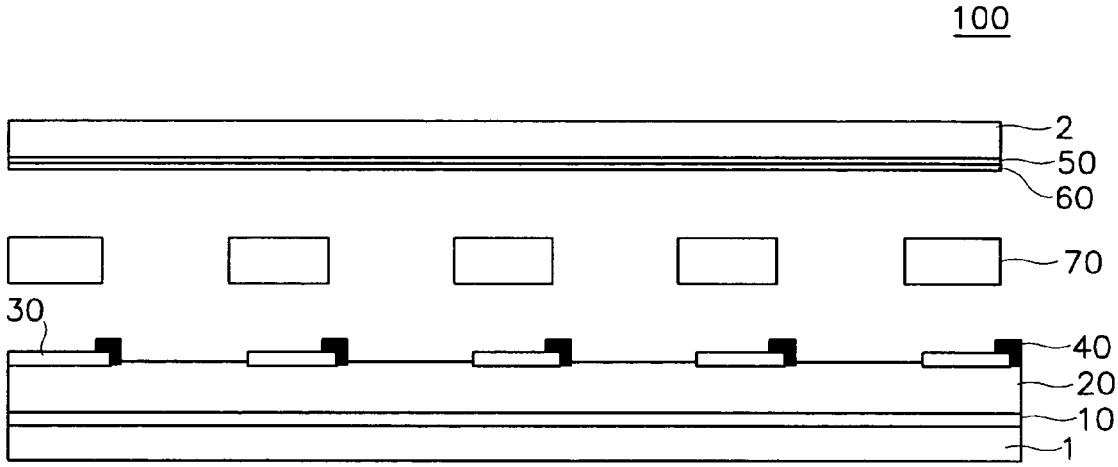
FIG. 2 is a cross-sectional view of the field emission display according to an exemplary embodiment of the present invention.

FIG. 1 is a plan view of a lower substrate of a field emission display according to an embodiment of the invention, and FIG. 2 is a cross-sectional view of the field emission display of the invention.

As shown in FIGS. 1 and 2, the field emission display according to the exemplary embodiment of the present invention includes two glass substrates 1 and 2 which are arranged opposite to each other and have a predetermined distance between them. A plurality of gate electrodes 10 are arranged substantially parallel to each other on the lower glass substrate 1 at specific intervals. The gate electrodes 10 are covered with an insulating layer 20. The insulating layer 20 may be is formed, for example, of hyaline, $SiO_2$, polyimide, nitride, a combination thereof, or a laminated structure thereof.

Figure 3:
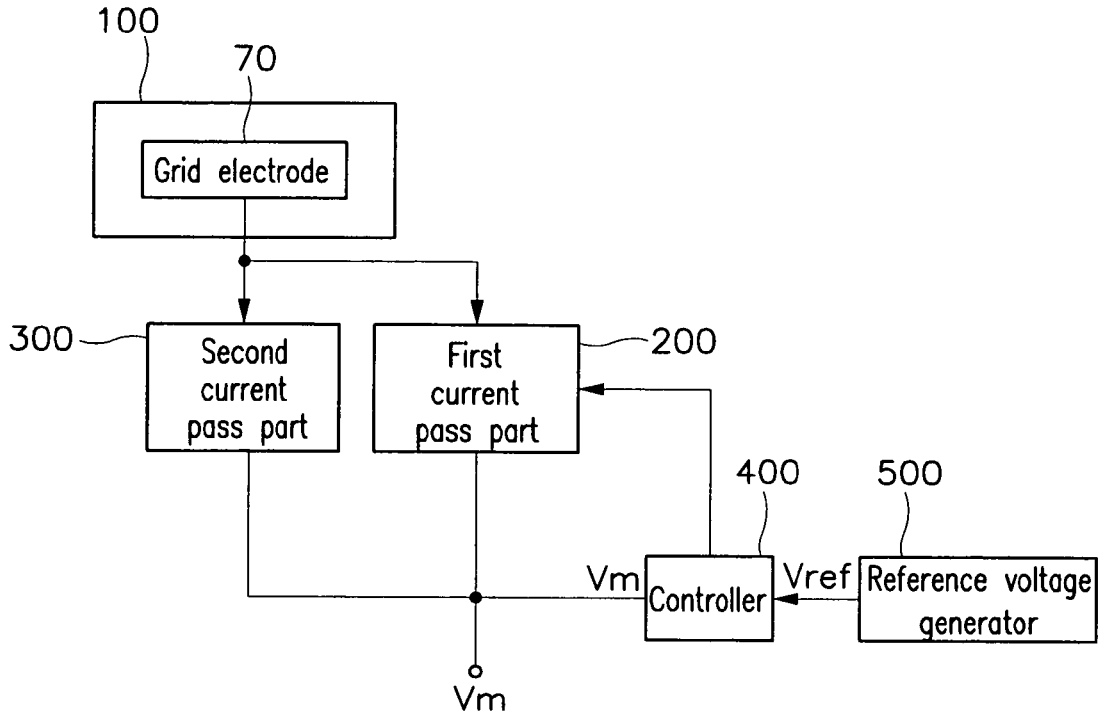
FIG. 3 is a block diagram of a device for driving the field emission display according to an exemplary embodiment of the present invention.

A plurality of cathode electrodes 30 are arranged substantially parallel to each other on the insulating layer 20 at specific intervals. The cathode electrodes 30 are arranged along a direction which is substantially orthogonal to the direction along which the gate electrodes are arranged. A pixel region is formed at each of the intersections of the cathode electrodes 30 and gate electrodes 10. In particular, the pixel region is an intersecting region of the two driving electrodes (the cathode electrode and the gate electrode). An electron emission source 40, for emitting electrons, is formed at each pixel region (i.e., at the interaction of the cathode electrode and the gate electrode), on the portion of the cathode electrode 30. Though the electron emission source 40 shown in FIGS. 2 and 3 is formed at an edge of the cathode electrode 30 down to the insulating layer 20 it should be understood by one of ordinary skill in the art that, it is not limited thereto. For example, the electron emission source 40 can be formed on the center of the cathode electrode 30 or only on one edge thereof. It can also be formed, for example, on both edges of the cathode electrode 30. The electron emission source 40 can be formed, for example, of a carbonaceous material, such as, carbon nanotubes, $C_{60}$ (fulleren), DLC (diamond like carbon), graphite, or a combination thereof.

In another exemplary embodiment, the insulating layer 20 may include contact holes exposing the gate electrodes. In this case, the opposite electrodes may be formed at the contact holes such that they are coupled to the gate electrodes through the contact holes, respectively.

The upper glass substrate 2 includes a plurality of anode electrodes 50 formed thereon. The anode electrodes are formed, for example, of a transparent conductive material, such as, ITO (Indium Tin Oxide) or IZO (Indium Zinc Oxide).

A fluorescent layer 60 is formed on the anode electrodes 50 and includes R, G, and B phosphors corresponding to each pixel region. The pixel region composed of the R, G, and B phosphors forms a single R,G,B pixel.

A grid electrode (or mesh electrode) 70 is formed between the glass substrates 1 and 2. The grid electrode 70 is made such that apertures are formed at portions of a thin sheet, corresponding to the pixel regions. The grid electrode 70 may be made, for example, of metal. Each aperture of the grid electrode 70 individually corresponds to a pixel region, and the R,G,B phosphors are formed in the fluorescent layer 60 corresponding to each pixel region.

Spacers (not shown) are formed between the lower glass substrate 1 and the grid electrode 70 and between the grid electrode 70 and the upper glass substrate 2 to fix the grid electrode 70 between the lower glass substrate 1 and the upper glass substrate 2. These spacers are formed on non-pixel regions of the lower glass substrate 1 and the upper glass substrate 2.

The field emission display according to this exemplary embodiment of the invention includes a driving device for allowing the current flowing through the grid electrode 70 to maintain a predetermined value.

Figure 4:
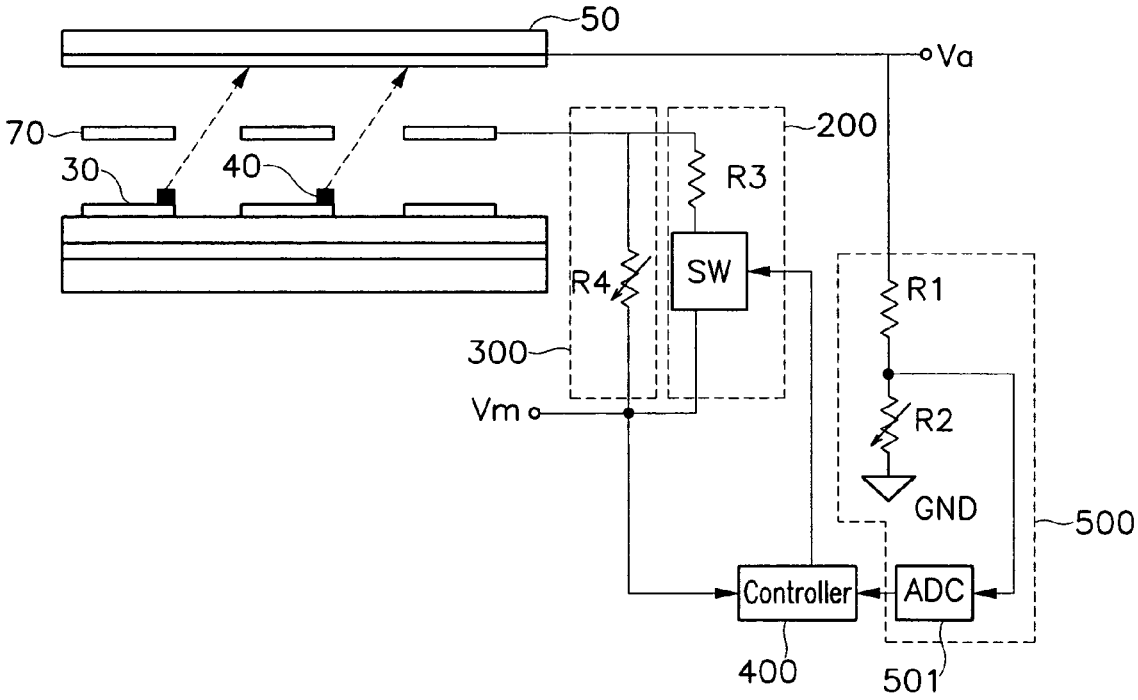
FIG. 4 illustrates the configuration of the driving device of FIG. 3 in detail.

FIG. 3 is a block diagram of the device for driving the field emission display (referred to as "driving device" hereinafter for convenience of explanation) according to an exemplary embodiment of the invention. FIG. 4 illustrates the driving device in more detail.

As shown in FIGS. 3 and 4, the driving device according to the exemplary embodiment of the invention includes first and second current pass parts 200 and 300 A reference voltage generator 500 and a controller 400 the first and second current pass parts 200 and 300 are coupled to the grid electrode 70. The reference voltage generator 500 generates a reference voltage and the controller 400 for selectively operates the first and second current pass parts 200 and 300 based on the reference voltage to allow the current flowing through the grid electrode 70 to be maintained at a predetermined value.

As shown in FIG. 4, the reference voltage generator 500 includes a pair of resistors R1 and R2 coupled in series to anode voltage Va. The anode voltage Va is applied to the anode electrode 50 which is formed on the upper glass substrate 2. The reference voltage generator 500 also includes a signal converter 501 which is coupled to the contact node between the resistors R1 and R2, as shown in FIG. 4.

The pair of resistors may include a variable resistor in order to control the reference voltage. In the exemplary embodiment shown in FIG. 4, the resistor R2 is the variable resistor. The signal converter 501 converts the anode voltage Va which is divided by the pair of resistors R1 and R2 into a digital signal before providing it to the controller 400. Although the divided voltage of the anode voltage Va is used as the reference voltage in this embodiment, it should be understood by one of ordinary skill in the art that a voltage other than the divided voltage can be used as the reference voltage.

The first current pass part 200 includes a resistor R3 coupled to the grid electrode 70, and a switch SW that operates under the control of the controller 400 to bias the current flowing through the resistor R3 to the controller 400. The second current pass part 300 includes a resistor R4, one terminal of which is coupled to the grid electrode 70 and the other terminal of which is coupled to the controller 400. Here, the resistance value of the resistor R4 of the second current pass part 300 is larger than that of the resistance value of the resistor R3 of the first current pass part 200. The resistor R4 is a variable resistor so as to control the current flowing through the second current pass part 300 to maintain a predetermined value.

Furthermore, the controller 400 includes a signal converter (not shown). This signal converter converts voltage Vm caused by the current flowing through the first and second current pass parts 200 and 300 into a digital signal. The controller 400 operates the first current pass part 200 at the initial stage to bias the current flowing through the grid electrode 70. In addition, the controller 400 compares the voltage detected from the first current pass part 200 with the reference voltage and blocks the first current pass part 200 based on the compared result. The controller 400 also operates the second current pass part 300.

The voltage caused by the current flowing through the first and second current pass parts 200 and 300 is provided to the controller 400 as a driving voltage for detecting the current flowing through the grid electrode 70 and is also used as a voltage for driving the grid electrode 70. For instance, the voltage Vm according to the current outputted through the first and second current pass parts 200 and 300 is used as the driving voltage of the grid electrode 70, or it can be inputted to a separate driving circuit to be used to control the driving voltage of the grid electrode 70.

The operations of the field emission display and the driving device thereof according to this invention are explained below on the basis of the aforementioned configuration.

When voltage is applied to the gate electrode 10, an electric field caused by the gate voltage penetrates the insulating layer 20 and a strong electric field is formed in the electron emission source 40. The electron emitting source 40, emits electrodes according to the field emission.

For example, a high-level DC voltage Va may be applied to the anode electrodes 50 and a low-level DC voltage Vg may be applied to the gate electrodes 10. In addition, a voltage Vm which is lower than the anode voltage Va but higher than the gate voltage Vg, is applied to the grid electrode 70. Additionally, a voltage that is higher than the grid voltage Vm is applied to unselected cathode electrodes and a negative voltage Vc is provided to selected cathode electrodes.

Then, electrons are emitted from the electron emission source 40 according to an electric field caused by a voltage difference Vg−Vc between the cathode electrodes 30 and the gate electrodes 10. The electrons pass through the contact holes formed in the grid electrode 70 due to the voltage Vm applied to the grid electrode 70. The electrons that have passed through the contact holes of the grid electrode 70 reach the fluorescent layer 60 placed on the upper glass substrate 2 at portions of the florescent layer 60 corresponding to the contact holes. The electrons which pass through the contact holes produce colors corresponding to the phosphors of the fluorescent layer 60. Here, the electrons emitted from the electron emission source 40 may not pass through the contact holes of the grid electrode 70 as some of the emitted electrons may collide with the grid electrode 70. The collision of emitted electrons with the grid electrode 70 increases the amount of electrons flowing through the grid electrode 70.

Accordingly, the driving device checks the variation in the current flowing through the grid electrode 70 to control the current of the grid electrode 70 to maintain a predetermined level. For this, the controller 400 of the driving device operates the first current pass part 200 at the initial stage to check the current flowing through the grid electrode 70.

Referring to FIG. 4, the controller 400 turns on the switch SW of the first current pass part 200 to allow current to flow into the grid electrode 70 through the first current pass part 200.

When the switch SW of the first current pass part 200 is turned on, the current flowing through the grid electrode 70 goes to the controller 400 through the first current pass part 200 because the resistance value of the resistor R3 of the first current pass part 200 is considerably lower than the resistance value of the resistor R4 of the second current pass part 300. At this time, the voltage Vm caused by the current flowing through the first current pass part 200 is applied to the grid electrode 70 to continuously drive it.

Meanwhile, the reference voltage generator 500 accepts the anode voltage Va applied to the anode electrode 50 and divides the voltage depending on a resistance ratio of the two resistors R1 and R2 that are coupled in series. The reference voltage generator 500 and then converts the divided voltage into a digital signal using the signal converter 501 and provides the digital signal to the controller 400. The divided voltage is used as the reference voltage Vref.

The controller 400 compares the reference voltage Vref provided by the reference voltage generator 500 with the voltage Vm (referred to as the "driving voltage" hereinafter) caused by the current supplied through the first current pass part 200. In particular, the controller 400 checks whether the current flowing through the grid electrode 70 exceeds the reference voltage Vref.

When the driving voltage Vm is lower than the reference voltage Vref, it is judged that the current flowing through the grid electrode 70 maintains the predetermined value so that an abnormal state does not occur. Accordingly, the controller 400 leaves the switch SW of the first current pass part 200 turned on. By leaving the switch SW on, the driving voltage Vm, according to the current flowing through the first current pass part 200 is applied to the grid electrode 70.

In the case where the electrons increasingly collide with the grid electrode 70 such that the current flowing through the grid electrode increases and the driving voltage Vm which is detected through the first current pass part 200 is higher than the reference voltage Vref, the controller turns off the switch SW of the first current pass part 200. By turning off the switch SW, the current of the grid electrode 70 flows through the second current pass part 300.

Accordingly, the current of the grid electrode 70 flows through the second current pass part 300. In this case, the quantity of current flowing through the second current pass part 300 decreases because the resistor R4 of the second current pass part 300 has a high resistance value. This also decreases the voltage applied to the grid electrode 70 so as to allow the current flowing to the grid electrode 70 to maintain the predetermined value again. Therefore, damage to the display due to an abrupt current increase in the grid electrode 70, system is prevented.

The controller 400 compares the driving voltage Vm detected according to the current flowing through the second current pass part 300 with the reference voltage Vref, and turns on the switch SW of the first current pass part 200 again when the driving voltage Vm is lower than the reference voltage Vref. When the switch SW is on the current of the grid electrode 70 is allowed to flow through the first current pass part 200.

The first current pass part 200 having a low resistance and the second current pass part 300 having a high resistance are selectively operated according to the quantity of current flowing through the grid electrode 70 so that the voltage Vm applied to the grid electrode 70 can be effectively controlled in order to allow the current flowing through the grid electrode 70 to maintain the predetermined value.

Although the aforementioned embodiment describes the method of controlling the current of the grid electrode in a field emission display constructed with the gate electrodes 10 under the cathode electrodes 30, the grid electrode current control method of the invention can be applied to field emission displays having different structures. For example, the present invention can be applied to a structure in which the gate electrodes are located on the cathode electrodes. As those skilled in the art can control the current of the grid electrode of the field emission display having this structure on the basis of the above-described embodiment, a detailed explanation thereof is omitted.

Also, in various embodiments, according to this invention the form of the gate electrodes, the cathode electrodes, and the anode electrodes can be varied. For example, the anode electrode and the cathode electrode may each be a line, while the gate electrode can be a surface or a line. In another example, the gate electrode and the cathode electrode are each lines form which intersect each other, and the anode electrode can be a sheet or a line.

In various exemplary embodiments of the invention, the gate electrode can, for example, be a single sheet or a plurality of lines, and the cathode electrode and the anode electrode can be plural.

As described above, the invention can uniformly maintain the quantity of the current flowing through the grid electrode in the field emission display. This protects the display system from being damaged due to an abrupt current increase in the grid electrode. Furthermore, in the case the grid electrode is formed from a thin metal plate, vibration caused by an increase in current can be substantially or completely prevented in the grid electrode, and accordingly, noise due to vibration can be prevented. Moreover, the driving device that controls the current of the grid electrode is configured of a digital circuit so that current control can be performed rapidly and accurately.

The forgoing embodiments are merely exemplary and are not to be construed as limiting the invention. The present teachings can be readily applied to other types of apparatus. The description of the invention is intended to be illustrative, and not to limit the scope of the claims. Many alternatives, modifications, and variations will be apparent to those skilled in the art.

What is claimed is:

1. A field emission display, comprising:

a first substrate and a second substrate arranged opposite to each other and having a distance there between;

at least one first electrode formed on the first substrate;

at least one second electrode formed on the second substrate;

at least one third electrode insulated from the at least one first electrode;

an electron emission source connected to the third electrode;

a fourth electrode formed between the first substrate and the second substrate, the fourth electrode controlling electrons emitted from the electron emission source; and a driver for detecting a current flowing through the fourth electrode and controlling a driving voltage applied to the fourth electrode according to the detected current, wherein the current flowing through the fourth electrode is maintained at about a predetermined value.

2. The field emission display as claimed in claim 1, wherein the electron emission source is connected to the third electrode.

3. The field emission display as claimed in claim 1, wherein the driver comprises:

a first current pass part coupled to the fourth electrode, wherein the first current pass part is used to bias the current flowing through the fourth electrode;

a second current pass part coupled to the fourth electrode, wherein the second current pass part is used to bias the current flowing through the fourth electrode;

a reference voltage generator for generating a reference voltage; and a controller for selectively operating the first current pass part and the second current pass part based on the reference voltage, wherein the driving voltage applied to the fourth electrode is controlled according to a voltage caused by current flowing through the first current pass part or the second current pass part.

4. The field emission display as claimed in claim 3, wherein the first current pass part includes a first resistor having a first resistance value, and the second current pass part includes a second resistor having a second resistance value, the second resistance value being larger than the first resistance value.

5. The field emission display as claimed in claim 3, wherein the controller operates the first current pass part at an initial stage to bias the current flowing through the fourth electrode, compares the driving voltage outputted through the first current pass part with the reference voltage, and operates the second current pass part when the driving voltage is higher than the reference voltage to bias the current flowing through the fourth electrode through the second current pass part.

6. The field emission display as claimed in claim 4, wherein the first resistor of the first current pass part is coupled to the fourth electrode, and the first current pass part further includes a switch, which is controlled by the controller, for selectively passing current outputted through the first resistor to the controller.

7. The field emission display as claimed in claim 6, wherein the controller turns off the switch when the driving voltage is higher than the reference voltage, to allow the current outputted from the fourth electrode to flow through the second current pass part.

8. The field emission display as claimed in claim 4, wherein the second resistor of the second current pass part is a variable resistor.

9. The field emission display as claimed in claim 3, wherein the reference voltage generator includes a pair of resistors coupled in series to at least one second electrode to divide voltage applied to the second electrodes, and a signal converter for converting the divided voltage outputted through the pair of resistors into a digital signal to provide it to the controller as the reference voltage.

10. The field emission display as claimed in claim 9, wherein the pair of resistors includes a variable resistor.

11. The field emission display as claimed in claim 1, wherein at least one third electrode is located between the first substrate and the first electrode.

12. The field emission display as claimed in claim 1, wherein at least one first electrode and at least one second electrode cross over each other, and the third electrode is in a form of a sheet.

13. The field emission display as claimed in claim 1, wherein the first electrode and the second electrode are lines which cross over each other, and the third electrode is a line and wherein the first electrode, the second electrode and the third electrode have a length which is substantially longer than a width of the line.

14. The field emission display as claimed in claim 1, wherein the first electrode and the third electrode are lines which cross over each other, and the second electrode is in a form of a sheet.

15. The field emission display as claimed in claim 1, wherein the first electrode and the third electrode in the line form intersect each other, and the second electrode has a line form.

16. A device for driving a field emission display including a first substrate and a second substrate arranged opposite to each other having a specific distance there between;

at least one first electrode formed on the first substrate;

at least one second electrode formed on the second substrate;

at least one third electrode insulated from the at least one first electrode;

an electron emission source connected to the third electrode; and a fourth electrode formed between the first substrate and the second substrate, the fourth electrode controlling electrons emitted from the electron emission source such that they reach the at least one second electrode, the device comprising:

a first current pass part coupled to the fourth electrode for biasing the current flowing through the fourth electrode;

a second current pass part coupled to the fourth electrode for biasing the current flowing through the fourth electrode;

a reference voltage generator for generating a reference voltage; and a controller for selectively operating the first current pass part and the second current pass part based on the reference voltage, the controller controlling the driving voltage applied to the fourth electrode according to voltage caused by current flowing through the first current pass part or the second current pass part.

17. The device as claimed in claim 16, wherein the first current pass part includes a first resistor having a first resistance value, and the second current pass part includes a second resistor having a second resistance value, the second resistance value being larger than the first resistance value.

18. The device as claimed in claim 16, wherein the controller operates the first current pass part at the initial stage to bias the current flowing through the fourth electrode, compares the driving voltage outputted through the first current pass part with the reference voltage, and operates the second current pass part when the driving voltage is higher than the reference voltage to bias the current flowing through the fourth electrode through the second current pass part.

19. The device as claimed in claim 17, wherein the first resistor of the first current pass part is coupled to the fourth electrode, and the first current pass part further includes a switch, controlled by the controller, for selectively passing current outputted through the first resistor to the controller.

20. The device as claimed in claim 19, wherein the controller turns off the switch when the driving voltage is higher than the reference voltage, to allow the current outputted from the fourth electrode to flow through the second current pass part.

21. The device as claimed in claim 16, wherein the reference voltage generator includes a pair of resistors coupled in series to the second electrodes to divide voltage applied to at least one second electrode, and a signal converter for converting the divided voltage outputted through the pair of resistors into a digital signal to provide it to the controller as the reference voltage.

22. The device as claimed in claim 16, wherein at least one third electrode is located between the first substrate and at least one first electrode.

23. A driving device for driving a field emission display, the device including a first current pass part coupled to a grid electrode;

a second current pass part coupled to the grid electrode;

a reference voltage generator for generating a reference voltage; and a controller for selectively operating the first current pass part and the second current pass part based on a comparison of a driving voltage of the grid electrode to the reference voltage, wherein a current flowing through the grid electrode is substantially maintained at a predetermined value.

24. The device of claim 23, wherein the first current pass part includes a switch which is controlled by the controller, wherein when the switch is closed, current flows to the grid electrode via the first current pass part.

25. The device of claim 24, wherein the switch is opened when the driving voltage based on the current flowing through the grid electrode is greater than the reference voltage.

26. The device of claim 25, wherein the switch is closed when the driving voltage is at or below the reference voltage.

27. The device of claim 26, wherein:

the first current pass part includes a first resistor;

the second current pass part includes a second resistor, and a resistance of the second resistor is greater than a resistance of the first resistor.

28. The device of claim 27, wherein the reference voltage generator includes a third resistor and a variable resistor which are connected in series and a terminal of the third resistor is coupled to a voltage source for an anode electrode of the field emission display, such that the reference voltage generator divides a voltage of the voltage source for the anode electrode based on a ratio of a resistance of the third resistor to a resistance of the variable resistor, converts a voltage at a mutual terminal of the third resistor and the variable resistor into a digital signal, and provides the digital signal to the controller.

29. A field emission display, comprising:

a first substrate and a second substrate arranged opposite to each other and having a distance there between;

at least one first electrode formed on the first substrate;

at least one second electrode formed on the second substrate;

at least one third electrode insulated from the at least one first electrode;

an electron emission source connected to the third electrode; and a fourth electrode formed between the first substrate and the second substrate, the fourth electrode controlling electrons emitted from the electron emission source.

30. The field emission display of claim 29, further comprising:

a driver for detecting a current flowing through the fourth electrode and controlling a driving voltage applied to the fourth electrode according to the detected current, wherein the current flowing through the fourth electrode is maintained at about a predetermined value.

* * * * *